United States Patent [19]

Prestele et al.

[11] Patent Number: 4,673,307

[45] Date of Patent: Jun. 16, 1987

[54] WASHING BRUSH WITH ADJUSTABLE HEAD

[75] Inventors: Erich Prestele, Voehringen; Alfred Schneider, Merklingen; Willi Hepperle, Westerstetten; Johann Katzer, Neu-Ulm; Christian Stephany, Ulm; Franz Lopic, Nersingen, all of Fed. Rep. of Germany

[73] Assignee: Gardena Kress & Kastner GmbH, Fed. Rep. of Germany

[21] Appl. No.: 753,390

[22] Filed: Jul. 10, 1985

[30] Foreign Application Priority Data

Jul. 20, 1984 [DE] Fed. Rep. of Germany ..... 3426748

[51] Int. Cl.[4] ..... A46B 11/00; A46B 11/06

[52] U.S. Cl. ..... 401/289; 15/29; 15/144 R; 15/172; 401/268; 401/281; 401/291

[58] Field of Search ..... 401/40, 268, 289, 290, 401/291, 281; 15/28, 29, 144 R, 172, 244 A

[56] References Cited

U.S. PATENT DOCUMENTS

| | | | |
|---|---|---|---|
| 663,247 | 12/1900 | Sturgis | 401/290 X |
| 727,035 | 5/1903 | Van Loan | 15/144 R |
| 1,439,913 | 12/1922 | Saxe | 15/172 |
| 1,746,685 | 2/1930 | Struble et al. | 401/290 X |
| 2,047,613 | 7/1936 | Brown | 15/172 X |
| 2,130,223 | 9/1938 | Beaurline | 401/291 X |
| 2,536,309 | 1/1951 | Rackliffe | 15/144 R |
| 2,707,293 | 5/1955 | Ferrer | 401/289 |
| 3,047,902 | 8/1962 | Laitner | 401/289 X |
| 3,421,171 | 1/1969 | Tsuruzawa | 15/172 |
| 3,619,846 | 11/1971 | Krusche et al. | 15/172 |
| 3,782,837 | 7/1972 | Feldmann | 401/289 X |
| 3,869,748 | 3/1975 | Krusche | 15/172 |

FOREIGN PATENT DOCUMENTS

| | | | |
|---|---|---|---|
| 862365 | 2/1971 | Canada | 15/144 R |
| 8304897 | of 0000 | Fed. Rep. of Germany | 15/144 |
| 7246522 | of 0000 | Fed. Rep. of Germany | 15/144 |
| 6931637 | of 0000 | Fed. Rep. of Germany | 15/144 |
| 545815 | 8/1922 | France | 15/144 R |
| 21776 | of 1897 | United Kingdom | 15/144 R |
| 25688 | of 1911 | United Kingdom | 15/144 R |

*Primary Examiner*—Steven A. Bratlie

*Attorney, Agent, or Firm*—Steele, Gould & Fried

[57] ABSTRACT

A washing brush contains a brush body with a central opening, that engages a cylindrical projection, which is positioned in the vicinity of the edge of a cover. The cover is in one piece with a gripping member, which can be connected to a water-carrying member.

In the center of the cover and the brush body is provided an annular locking member, which passes through the cover within the liquid-carrying area in the form of a push button. By depressing the push button, it is possible to release the angular locking member between the gripping member and the brush body.

17 Claims, 4 Drawing Figures

FIG.1
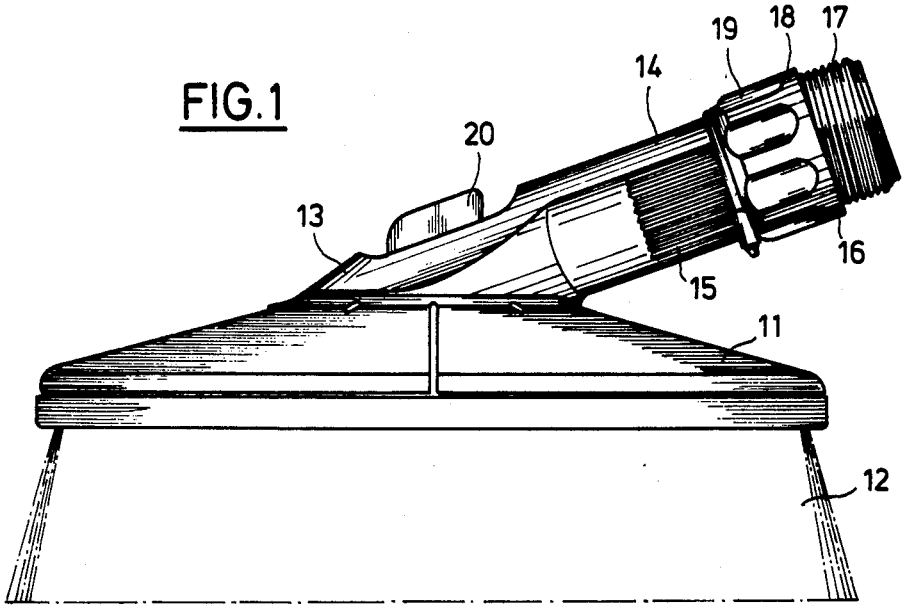
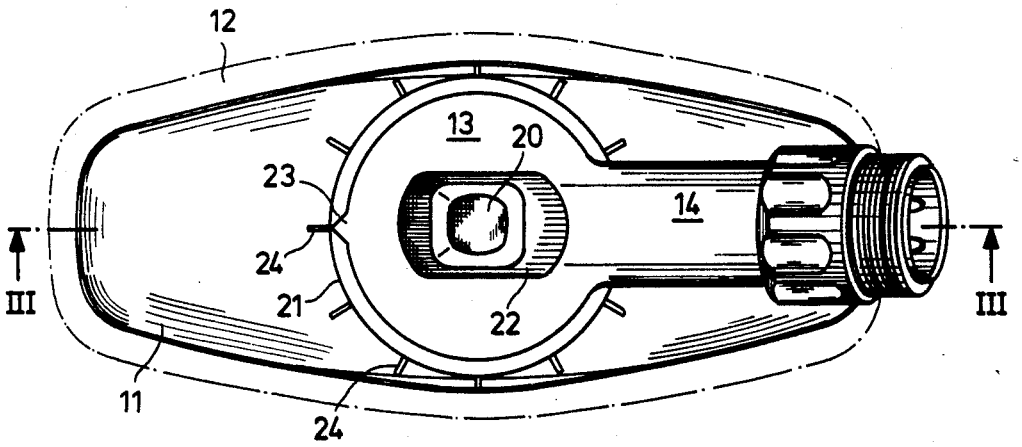
FIG. 2

FIG. 3
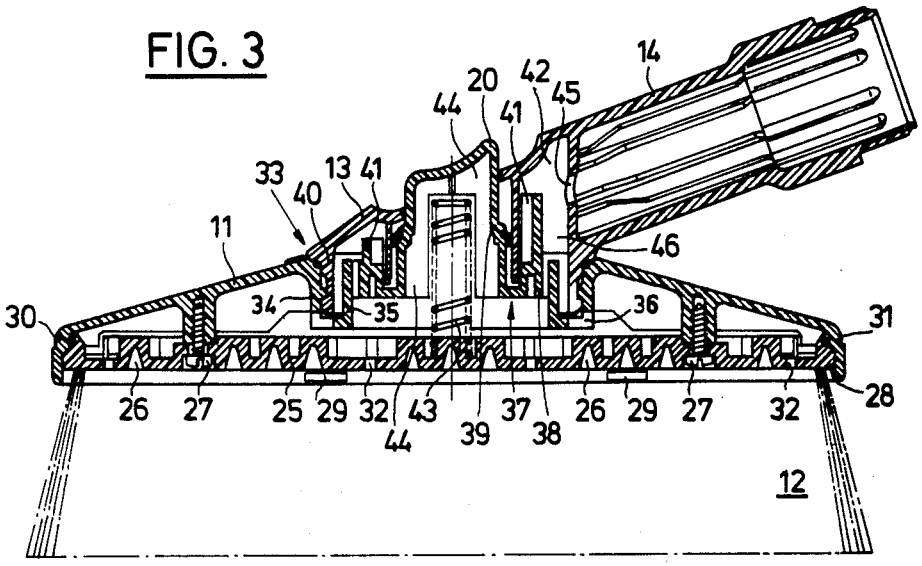
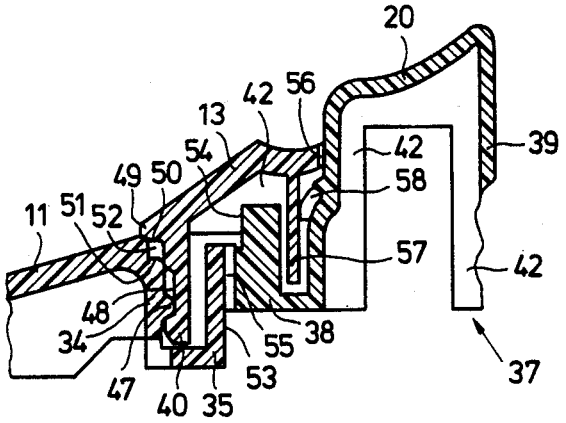
FIG. 4

WASHING BRUSH WITH ADJUSTABLE HEAD

BACKGROUND OF THE INVENTION

The invention relates to a brush with a tubular gripping member containing a cover, a brush body which can be turned with respect to the gripping member, as well as a locking member displaceably fixed on the gripping member and which co-operates with the brush body for its locking with respect to the gripping member.

Such a brush is known from German Utility Model 7246522. The brush body contains a bore at right angles thereto with a screw, about which can be turned a cover. The outside of the latter is provided with a locking pin, which can engage in various holes in the top of the brush body. For turning the brush body with respect to the grip, the operator must use two hands, which makes operation more difficult.

A washing brush is also known (German Utility Model 6931637), in which the brush body can be pivoted about an axis parallel to its longitudinal extension. However, with such a brush, other problems occur as compared with a brush in which the brush body is to be pivotable about an axis at right angles to its plane.

SUMMARY OF THE INVENTION

The object of the present invention is to provide a brush, particularly a washing brush, which has a simple construction, so that it can be easily and inexpensively manufactured, whilst permitting easy use, without the operational efficiency suffering.

According to the invention this object is achieved in that on its top surface the brush body is provided with a circular opening, which engages a circular edge of the cover, the locking member being arranged roughly in the center of the brush body and cooperates with a locking device preferably on the edge of the opening.

As a result of the arrangement of the locking member being centrally on the brush body, it is possible to operate the locking member with the hand holding the brush grip, eg. with the thumb. This makes easy its operation or use. In addition, the brush according to the invention has a simple construction.

The possibility of easy use is further improved in that the locking member is spring-loaded and can be released from its locked position by pressing in. In a case of a washing brush, the spring loading is reinforced by the pressure in the interior of the brush, so that the locking action is further improved under hydraulic pressure. The user can clearly feel the increased resistance during the operation of the locking member when in use.

According to a further development, the cover is provided in the vicinity of its edge with a roughly circular cylindrical projection, which engages in the brush body opening. This circular cylindrical projection leads to a better guidance and support of the cover or the gripping member connected in one piece thereto with respect to the brush body. The projection can be internally solid, but it is particularly favourable if it is hollow, so that it is in the form of a circular cylindrical ring.

According to the invention, in the vicinity of the edge of its opening, the brush body has an approximately circular cylindrical skirt, which is preferably directed into the brush body. Thus, particularly in conjunction with the projection of the cover there is a further improvement to the guidance and support of the brush body with respect to the cover. This not only ensures a play-free rotatability, but also ensures that the freedom from play still exists after long use. The play-free mounting is particularly of interest if the brush is a washing brush, where the water does not pass out of the joint and instead passes out of the brush surface.

Whereas in the prior art a screw engaging in a thread was necessary for mounting the cover on the brush body, the invention proposes that the projection and/or the skirt can have a slot and, in each case, the other part a rib engaging in the slot. This ensures a particularly easily obtained locking action. The two parts can merely be snapped into one another, for which purpose the rib and/or slot can have a corresponding shape. Preference is given to a construction, in which the rib is placed on the brush body and the slot on the cover.

In order to obtain a particularly favourable sealing action, a shoulder for mounting an O-ring is provided on the outside of the projection of the cover and/or the inside of the skirt. This is an extremely inexpensive component, so that good sealing is here obtained with simple means.

According to a further development of the invention, an inner circular cylindrical ring is connected by means of webs to the brush body skirt and concentric with respect thereto. This inner circular cylindrical ring can eg. be used for the improved guidance of the cover or for improving the seal. The webs leave openings free between them, through which the water can pass in an unimpeded manner.

If, as preferred by the invention, the cover projection is constructed as a hollow cylinder, it can advantageously engage between the skirt and the inner circular cylindrical ring, which leads to an improved guidance of the cover.

According to a further development, the bottom of the cover is provided in the vicinity of a passage for the drive element with a cylindrical skirt constructed as a bearing surface for a packing on the locking member. As the drive element is to move at right angles to the extension of the packing during its operation, it is appropriate to provide a larger bearing surface for the packing, which is brought about in a particularly advantageous manner by this measure.

Whereas in the prior art, the locking element cooperates with individual bores, according to the invention the locking member is provided on its outside with a tooth system, which engages in a tooth system on the brush body, a displacement of the locking member disengaging the teeth. These teeth also make it possible to fix the brush body with respect to the gripping member in much smaller steps, so that there is an advantageous influence on the usability of the brush. The tooth system can eg. comprise cross-sectionally rectangular webs with gaps between the latter. The webs can be bevelled, so that the sliding of the tooth system into one another is facilitated. It is particularly favourable if the tooth system of the brush body is positioned on the inside of the inner cylindrical ring.

According to the invention, the locking member can advantageously have a disc-shaped base with a hollow center stud, which passes through a passage opening of the cover. Thus, the locking member can not only be easily manufactured, but it is also possible for the tooth system to be arranged on the disc-shaped part, whilst the hollow center stud can be constructed in such a way that it is eg. adapted to the contour of a user's thumb, so that easier operation is possible.

The hollow center stud appropriately has at least partly a quadrangular or some other non-circular cross-section to ensure that during assembly the locking member is inserted with the correct alignment. The inner space of the hollow center stud can advantageously receive a compression spring, which is on the one hand supported in the hollow center stud and on the other hand on the brush body or the part receiving the brushes.

According to the invention, the locking member has guide pins arranged parallel to the rotation axis and they preferably co-operate with guide walls arranged on the bottom of the cover. This leads to an exact easy-action guidance of the locking member so that the risk of tilting or difficult action is eliminated. This is helped by the easy operation of the brush proposed by the invention.

BRIEF DESCRIPTION OF THE DRAWINGS

The invention is described in greater detail hereinafter relative to non-limitative embodiments and with reference to the attached drawings, wherein:

FIG. 1 a side view of a washing brush proposed by the invention.

FIG. 2 a plan view of the brush of FIG. 1.

FIG. 3 a longitudenal section roughly along line III—III of FIG. 2.

FIG. 4 a larger-scale view of a detail of the section of FIG. 3.

DETAILED DESCRIPTION OF THE PREFERRED EMBODIMENTS

The washing brush shown in FIG. 1 has a hollow brush body 11, to whose bottom can be fitted the diagrammatically represented bristles 12. At its side remote from the bristles 12, a cover 13 is arranged on the brush body 11 and passes in one piece into a tubular gripping member 14. The latter has grooving 15 on its outside, as well as a coupling 16 at its free end. Coupling 16 has an outwardly directed projection with an external thread 17, as well as a gripping ring 18 with gripping depressions 19. With the aid of the coupling 16, the washing brush can eg. be screwed to an extrusion handle.

A push button 20 projects roughly out of the center of cover 13 and forms part of the locking member, with the aid of which the cover 13 or the gripping member 14 connected in one piece thereto can be locked with respect to the brush body 11. When the push button 20 is depressed, the cover 13 can be turned about an axis running at right angles to the longitudinal axis FIG. 2 shows a plan view of the washing brush according to FIG. 1. Cover 13 has a substantially circular edge 21, which is partly covered by the tubular gripping member 14 in FIG. 2. In the center of cover 13 is provided a depression 22, which permits easier access to push button 20. This has a rectangular cross-section with rounded ends.

The axis about which the brush body 11 can be turned with respect to the fixed cover 13 is at right angles to the plane of the paper and passes through the center of the circle on which is located the edge 21 of the cover.

On the side remote from coupling 16, cover 13 is provided in the vicinity of its edge 21 with a pointer-like marking 23, whilst several locating marks 24 are provided opposite it on the brush body 11. These marks are used for the facilitated setting of the different locking positions, because in each locking position pointer 23 faces a locating mark 24. There are in all twelve locating marks 24 and there are also twelve possible angular positions.

FIG. 3 is a longitudinal section through the washing brush according to the invention. The bristles 12 are fixed to a base plate 25 screwed to the bottom of brush body 11. The bristles 12 are fixed in such a way that in each case a single bundle is inserted into one of the various conically, downwardly open recesses 26. Base plate 25 is screwed to the brush body 11 with the aid of two screws 27, the outer edge 28 of the base plate 25 being additionally wedged by individual ribs. An O-ring 30 is inserted between base plate 25 and outer edge 30 and is used for the downward sealing of the brush. Base plate 25 has a number of through-openings 32, from which the water can pass in a planned manner from the hollow interior of brush body 11 into the space between the bristles 12.

In its central area, the brush body 11 has an opening 33, whose edge has a cylindrical ring-like skirt 34 directed into the interior of brush body 11. Concentrically to skirt 34 is provided an inner circular cylindrical ring 35, which is connected to skirt 34 via webs 36, which between them form openings for the passage of the water.

In the vicinity of its edge, cover 13 is provided on its bottom surface with a cylindrical ring-like projection 40, which is arranged directly within skirt 34 and engages in the space between skirt 34 and cylindrical ring 35.

The locking member 37 is connected in non-rotary manner with cover 13 and has a roughly disc-shaped base 38 and a central hollow stud 39, which forms the push button 20 on its top surface. The hollow center stud 39 engages through an opening in cover 13. When the push button 20 is depressed, cover 13 can be turned at random with respect to the brush body 11 and projection 40 slides past the skirt 34.

Base 38 of locking member 37 is provided on its top with a total of four cross-sectionally rectangular guide pins 41, whereof only two can be seen in FIG. 3. The guide pins 41 have different lengths, so that they prevent an incorrect insertion of locking member 37. The guide pins 41 are in each case positioned directly in front of a guide wall 42, so that they bring about an exact guidance of locking member 37.

A compression spring 43 is inserted in the hollow central area of center stud 39 and is supported by its bottom surface on base plate 25. For guiding the compression spring 43 in center stud 39, the latter has radially directed walls 44 dimensioned in such a way that their reciprocal spacing corresponds to the external diameter of spring 43.

The water passes through the interior of the hollow gripping member 14, through a central opening 45 in a partition 46 and through the space between the cylindrical projection 40 and the cylindrical inner ring 35 into the interior of the brush body and from there through openings 32 to the bristles.

Details of the arrangement of the locking member can be gathered from FIG. 4.

The inwardly directed skirt 34 of brush body 11 is provided on its inside with a rib 47, whilst the facing outside of the cylindrical projection 40 of cover 13 has a groove 48. Rib 47 engages in the represented position in groove 48. The space between outer edge 49 of cover 13 and the outside of the cylindrical projection 40 forms a shoulder 50, which is spaced with respect to a similar shoulder 51 on brush body 11. For sealing purposes, an O-ring which is not shown in the drawing is inserted in the thus formed gap 52.

On the inside 53 of cylindrical inner ring 35 and on the outside 54 of base part 38 of locking member 37 is in each case provided a tooth system 55, the two tooth systems cooperating for locking purposes.

In the vicinity of the opening 56 for the locking member 37, the bottom of cover 13 is provided with a cylindrical skirt 57, whilst the hollow center stud 39 is provided in this area on its outside with a packing 58. The latter engages in a slot on the outside of the hollow center stud 39 and from there extends parallel to the side wall of the hollow center stud.

If the locking member 37 is moved downwards counter to the action of compression spring 43, then the two tooth systems 55 are disengaged, so that with the now secured push button 20 the cover 13 can be turned relative to the brush body 11 until, in the desired end position, a release of push button 20 once again leads to an engagement of the two tooth systems 55.

What is claimed is:

1. A fountain brush, comprising:

a cover;

a tubular gripping member extending from the cover, the gripping member being attachable to a source of water and defining a path for water from the source to the cover;

a hollow brush body rotatable about an axis with respect to the cover and having a base plate provided with openings for discharging the water, and bristles; and, a spring loaded pressure releasing locking member displaceably fixed in the cover adjacent said gripping member, the locking member being axially displaceable relative to the cover and relative to the brush body, the locking member being rotationally fixed to the cover, and rotationally fixed to the brush body except when the locking member is axially displaced, the locking member cooperating with the brush body for locking the brush body to the gripping member, the brush body being provided on a surface thereof receiving the cover with a circular opening which engages a circular edge of the cover, and the locking member being arranged approximately at the axis in the center of the brush body and the locking member and the brush body having engagable teeth forming a locking device at the edge of the opening, the locking device being disengagable by axial displacement of the locking member relative to the cover and the brush body thereby disengaging the engagable teeth.

2. A brush according to claim 1, wherein the cover is provided in the vicinity of its edge with an approximately circular cylindrical projection which engages in the opening of the brush body.

3. A brush according to claim 2, wherein in the vicinity of the edge of the opening, the brush body has an approximately circular cylindrical skirt.

4. A brush according to claim 3, wherein at least one of the projection and skirt has a slot and the other of the projection and skirt has a rib engaging in the slot.

5. A brush according to claim 3, wherein on the outside of the projection of the cover and the inside of the skirt is provided with at least one shoulder for the mounting of an O-ring.

6. A brush according to claim 3, wherein an inner cylindrical ring is connected by webs to the brush body skirt and concentrically with respect thereto.

7. A brush according to claim 6, wherein the projection of the cover is constructed as a hollow cylinder and engages between the skirt and the inner cylindrical ring.

8. A brush according to claim 1, wherein the cover is provided on its bottom surface in the vicinity of a passage opening for the locking member with a cylindrical skirt constructed as a mounting surface for a packing on the locking member.

9. A brush according to claim 1, wherein the locking member is provided on its outside with a tooth system which engages in a tooth system on the brush body, a displacement of the locking member leading to the disengagement of the tooth systems.

10. A brush according to claim 9, wherein the tooth system of the brush body has engagable teeth disposed on an inner cylindrical ring of the brush body.

11. A brush according to claim 1, wherein the locking member has a disc-like base and a hollow center stud which projects through a passage opening of the cover.

12. A brush according to claim 11, wherein the hollow center stud at least partly has a quadrangular cross-section.

13. A brush according to claim 11, wherein a compression spring is arranged in the center stud.

14. A brush according to claim 1, wherein the locking member has guide pins arranged parallel to the rotation axis and which cooperates with guide walls provided on the bottom of the cover.

15. A brush according to claim 1, wherein the diameter of the brush body opening corresponds approximately to the width of the brush body.

16. A fountain brush, comprising:

a tubular gripping member having a cover means fixed thereto and being adapted for connection to a source of water, the gripping member defining a path for water from the source;

a hollow brush body having a base plate with apertures and bristle means, said brush body being rotatable around an axis relative to said cover means and axially fixed to the cover means, the brush body being connected to the gripping member whereby the water is directed to the apertures, and, a spring loaded pressure releasable locking means arranged approximately at the axis in the center of said brush body, said locking means being urged by water pressure in the brush body and being axially displaceable relative to the brush body and rotationally fixed to said gripping member, the locking means cooperating with said brush body for rotationally locking the brush body in a stationary position to said cover means except when the locking means is axially depressed against said water pressure to disengage the locking means from the brush body, whereby pressure on said locking means causes displacement of said locking means and permits rotation of the brush body about the axis and water in said brush body provides a hydraulic pressure which provides resistance on said locking means against axial displacement.

17. The fountain brush according to claim 16 wherein said locking means includes tooth means which cooperates with tooth means on said brush body for locking said brush body into a predetermined position with respect to said cover means.

* * * * *